US007510075B2

(12) United States Patent
Olsen et al.

(10) Patent No.: US 7,510,075 B2
(45) Date of Patent: Mar. 31, 2009

(54) CONTAINER CARRIER

(75) Inventors: Robert Olsen, Medinah, IL (US); Christopher J. Ludwig, Rolling Meadows, IL (US)

(73) Assignee: Illinois Tool Works Inc., Glenview, IL (US)

( * ) Notice: Subject to any disclaimer, the term of this patent is extended or adjusted under 35 U.S.C. 154(b) by 71 days.

(21) Appl. No.: 11/073,829

(22) Filed: Mar. 7, 2005

(65) Prior Publication Data

US 2006/0196782 A1 Sep. 7, 2006

(51) Int. Cl.
*B65D 75/00* (2006.01)
*B65D 71/00* (2006.01)

(52) U.S. Cl. ..... 206/150; 206/427; 206/151; 206/162; 294/87.2

(58) Field of Classification Search ..... 206/150, 206/428, 427, 162, 163, 147, 141, 142, 143, 206/151, 175, 145; 294/87.2, 166, 33, 159
See application file for complete search history.

(56) References Cited

U.S. PATENT DOCUMENTS 5,487,465 A * 1/1996 Broskow ..... 206/150
5,642,808 A * 7/1997 Marco et al. ..... 206/150
5,655,654 A * 8/1997 Broskow ..... 206/150
5,746,310 A 5/1998 Slomski
5,788,301 A * 8/1998 Slomski ..... 294/87.2
5,806,667 A * 9/1998 Marco ..... 206/150
6,148,994 A * 11/2000 Olsen ..... 206/150
6,152,508 A * 11/2000 Slomski ..... 294/87.2
6,170,652 B1 * 1/2001 Olsen ..... 206/150
6,230,880 B1 * 5/2001 Marco et al. ..... 206/150
2004/0004365 A1 * 1/2004 Olsen ..... 294/87.2

FOREIGN PATENT DOCUMENTS

EP 0 842 865 A1 5/1998
EP 1 077 185 A2 2/2001
EP 1 308 398 A2 5/2003

OTHER PUBLICATIONS

Carrier Design, Mar. 10, 1992.

* cited by examiner

*Primary Examiner*—Mickey Yu
*Assistant Examiner*—Steven A. Reynolds
(74) *Attorney, Agent, or Firm*—Pauley Peterson & Erickson

(57) ABSTRACT

A flexible carrier for carrying a plurality of containers includes a flexible sheet having a row of container receiving apertures formed therein. The flexible carrier further includes a handle integrated with respect to the flexible sheet and may further include a panel integrated with respect to at least one row of the container receiving apertures on an opposite side of the row of container receiving apertures from the handle. A package is formed by fanning out the two rows of container receiving apertures and inserting a plurality of containers, each within a respective container receiving aperture.

30 Claims, 4 Drawing Sheets

CONTAINER CARRIER

BACKGROUND OF THE INVENTION

1. Field of the Invention

This invention relates to a flexible carrier for carrying a plurality of containers such as bottles or cans.

2. Description of Prior Art

Conventional container carriers are often used to unitize a plurality of similarly sized containers, such as cans, bottles, jars and boxes and/or similar containers that require unitization. Plastic ring carriers and box carriers are two such conventional container carriers.

The plastic ring carrier produces a unitized package for containers using little material. However, in its traditional form, the plastic ring carrier has little or no advertising or promotional printing space. Conversely, the box carrier generally has a relatively large amount of area for promotional graphics. Disadvantageously, the box carrier requires a relatively large amount of material, permits bottles to fall out if it is not maintained in an upright position, and usually shrouds much of the actual containers. Therefore, there is a need for a package that incorporates the stability and economy of a ring carrier and provides useful promotional area.

Flexible ring carriers are applied to containers by stretching the carrier around the diameter of the container, and allowing the stretched carrier to recover, providing a tight fit. The carrier is typically applied to the chime or rib, where this structure exists, or to the main sidewall.

Application of traditional flexible ring carriers may result in inversions or local irregularities in portions of the carrier. In particular, the complex and variable geometries of carriers, containers, and application parameters sometimes yields undesirable, inconsistent or unpredictable local characteristics in the applied carrier, such as kinking, inverting, or cantilevering along the perimeter of the carrier or even around the containers. Such conditions may result in a loose and/or "floppy" package that lacks tight unitization of the containers or a non-smooth or inverted perimeter that is less attractive and the disposition of additional carrier features may be negatively affected as well.

SUMMARY OF THE INVENTION

The present invention is directed to a flexible carrier for containers that includes an upright handle and an arrangement of container receiving apertures that create a tight, unitized package of containers. The flexible carrier may further include one or more display panels.

According to preferred embodiments of this invention, each flexible carrier preferably includes two layers of flexible sheet each defining a row of container receiving apertures, each for receiving a container. Specifically, two layers of flexible sheet are preferably connected along a longitudinally extending centerline, such as a weld.

The container receiving apertures are preferably formed in a geometry that results in a tight unitization of containers, particularly in a two-wide direction of the resultant package. Specifically, each container receiving aperture is preferably tapered along an inner edge toward the weld of the flexible carrier. Each container receiving aperture may comprise at least five generally straight segments that together form a generally polygonal shape that includes a tapered inner, or handle side, edge.

A handle is preferably connected along a weld side of the row of container receiving apertures. A plurality of struts may connect the handle with a side of the row of container receiving apertures, preferably between the weld and the handle.

In addition, a panel is preferably formed along a side of the row of container receiving apertures opposite the handle. The panel preferably accommodates graphics, promotional and/or other information related to the containers and the package. According to one embodiment of the invention, a second panel may extend from the opposite side of the carrier resulting in two panels, each extending from opposite sides of row of container receiving apertures. As such, two contiguous panels may be formed in the two layers of flexible sheet.

The resulting package includes two layers of flexible sheet joined with the longitudinally extending weld and with row of container receiving apertures formed in each layer. One row of container receiving apertures is formed on each side of the weld resulting in the flexible carrier fanning out at the weld to permit a generally flat plane of engagement within which the containers are inserted. The handle then extends upwardly from the weld and between each row of container receiving apertures. One or more panels accordingly extend downwardly from at least one row of container receiving apertures so that each panel extends generally flush with the respective row of containers.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
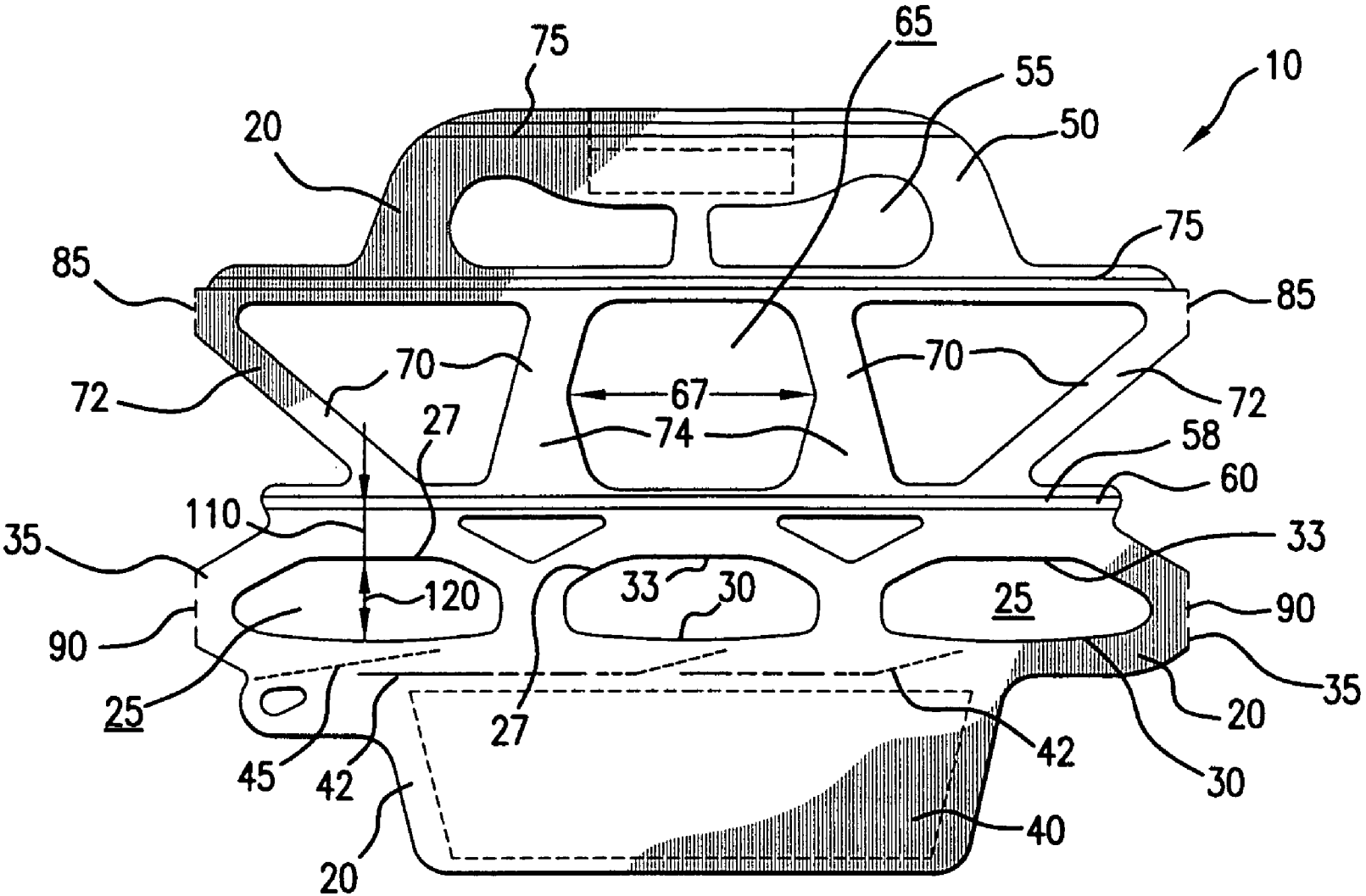
FIG. 1 is a side elevational view of a flexible carrier according to one preferred embodiment of this invention.
Figure 2:
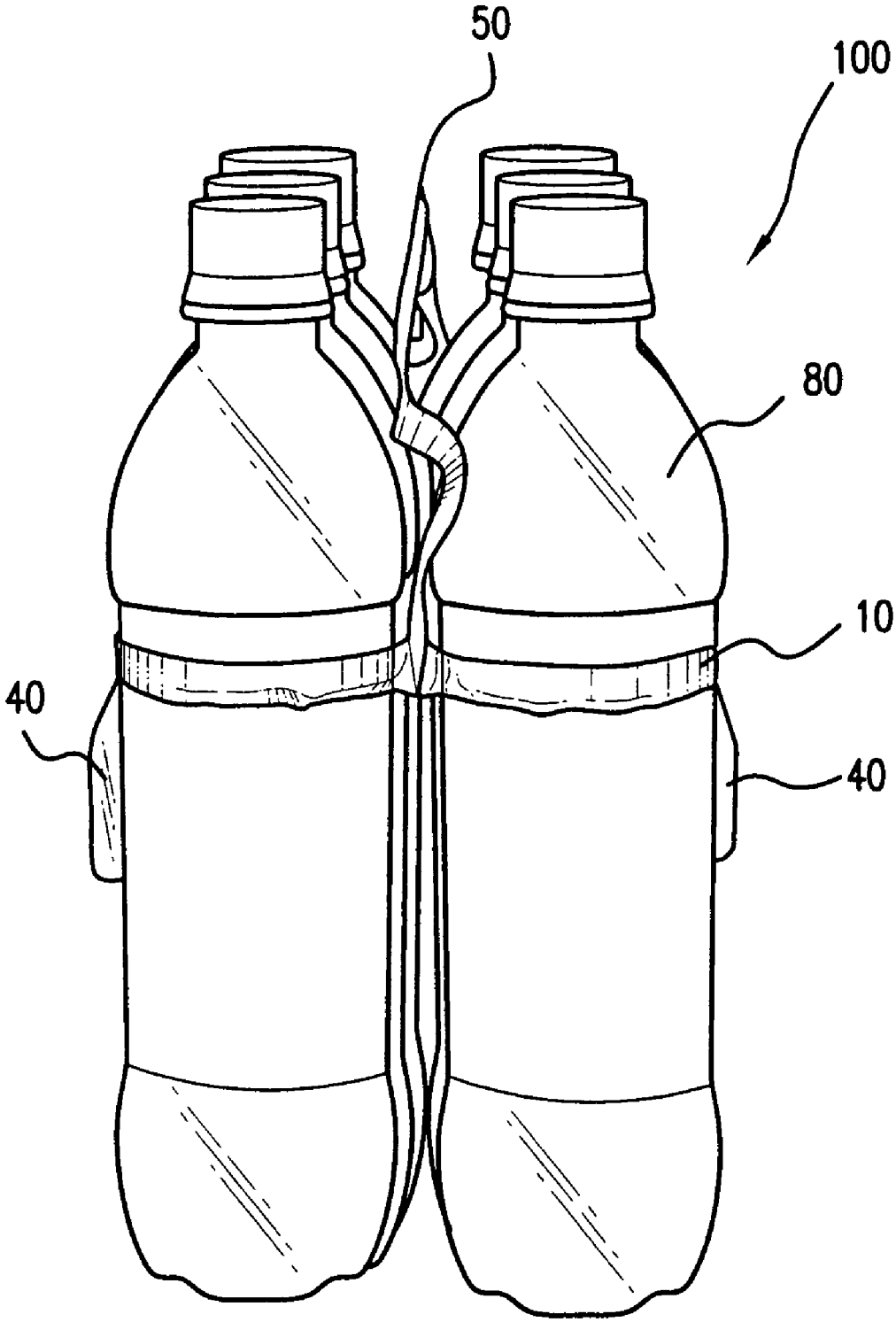
FIG. 2 is a front view of a package of containers according to one preferred embodiment of this invention.
Figure 3:
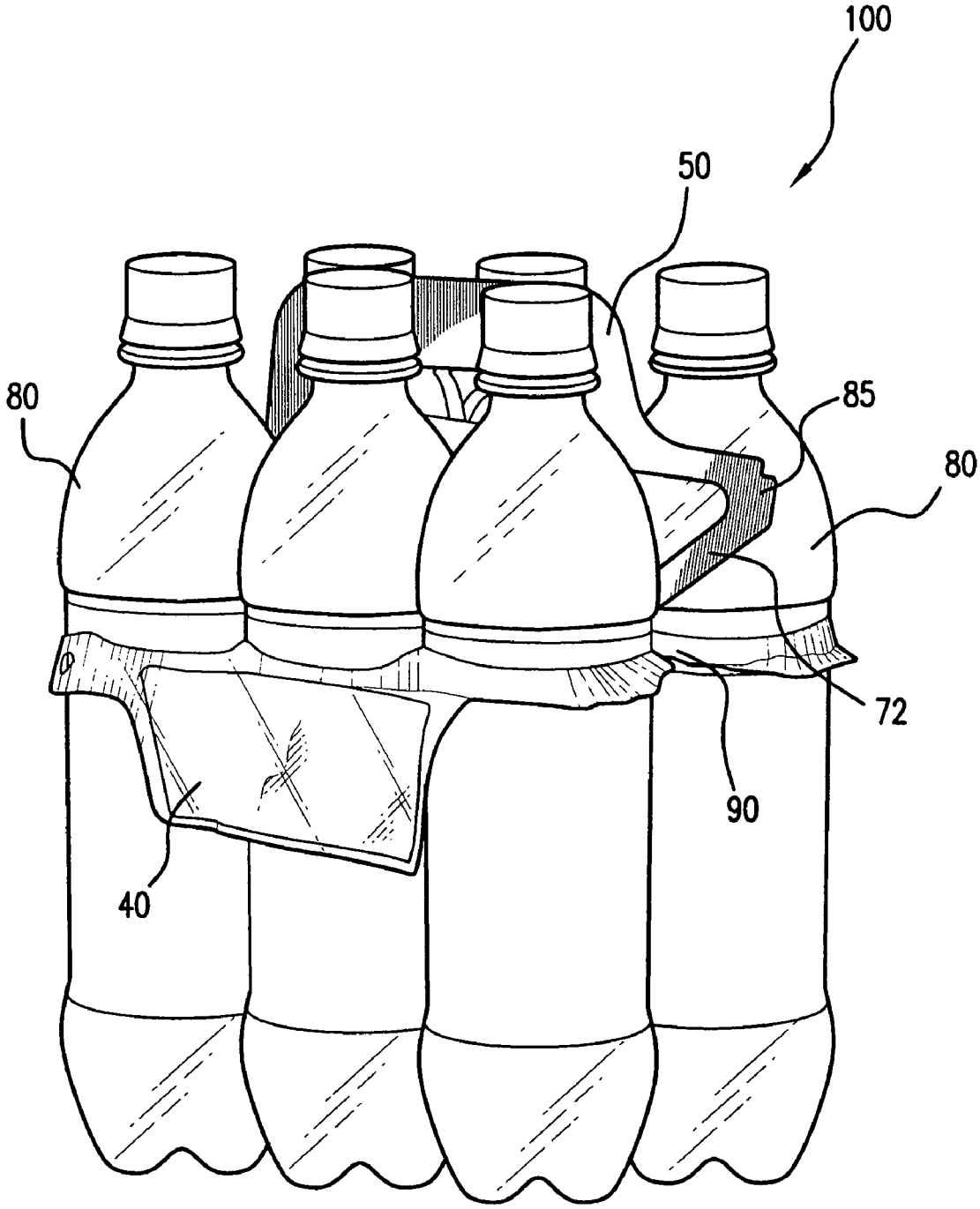
FIG. 3 is a front left perspective view of a package of containers according to one preferred embodiment of this invention.

FIG. 1 shows flexible carrier 10 for unitizing six containers to form a unitized package. FIGS. 2 and 3 show a package of unitized containers. Although FIGS. 1-3 illustrate various structures for flexible carrier 10 of the invention, the illustrations are exemplary, and the invention is not limited to the flexible carriers 10 or packages shown. For example, flexible carrier 10 may be configured and used to unitize four, eight, twelve or any other desired number of containers.

The containers, such as those shown in packages in FIGS. 2 and 3, are preferably bottles. Although bottles are shown in FIGS. 2 and 3, cans or any other commonly unitized container may be used with flexible carrier 10 according to this invention. The containers are preferably, though not necessarily, like-sized within a single flexible carrier 10.

Each flexible carrier 10 preferably includes flexible sheet 20 defining a plurality of container receiving apertures 25, each for receiving container 80. Specifically, two layers of flexible sheet 20 are connected along a longitudinally extending centerline 58. Centerline 58 as used herein generally describes a segment between rows of container receiving apertures 25 and/or between layers of flexible sheet 20.

According to one preferred embodiment of this invention, centerline 58 comprises weld 60 that joins the two layers of flexible sheet 20. The two layers of flexible sheet 20 may be coextruded, welded, or otherwise joined together to create flexible carrier 10. "Weld" as used in the specification and claims may be defined as a hot weld, cold weld, lamination or any other manner of connection that joins two sheets of material known to those having ordinary skill in the art.

As shown in FIG. 1, a row of container receiving apertures 25 is preferably formed in each layer of the two layers of flexible sheet 20. As such, one row of container receiving apertures 25 is preferably formed along each side of the centerline, such as weld 60. Container receiving apertures 25 are preferably formed in a geometry that results in a tight unitization of containers 80 without excess play and/or sliding between and among containers 80 and flexible carrier 10.

According to one preferred embodiment of this invention, a centerline distance 110 between centerline 58 and an inner, tapered edge of container receiving aperture 25 is approximately half of a width 120 of container receiving aperture. Other suitable geometries maybe provided that result in tight unitization of containers 80, particularly in the two wide, or transverse direction of package 100.

Container receiving apertures 25 are preferably elongated in a longitudinal direction of flexible carrier 10. Specifically, according to one preferred embodiment of this invention, each container receiving aperture 25 include a length that extends longitudinally across flexible carrier 10 that is between 2 and 4 times greater than a corresponding width. More specifically, each container receiving aperture 25 is preferably between approximately 2.5 and approximately 3.5 times longer than wide. For example, flexible carrier 10 shown in FIG. 1 includes container receiving apertures 25 in outer positions that each have a length approximately 3.0 times greater than a corresponding width and a container receiving aperture 25 in a center position that has a length approximately 2.8 times greater than a corresponding width.

Figure 4:
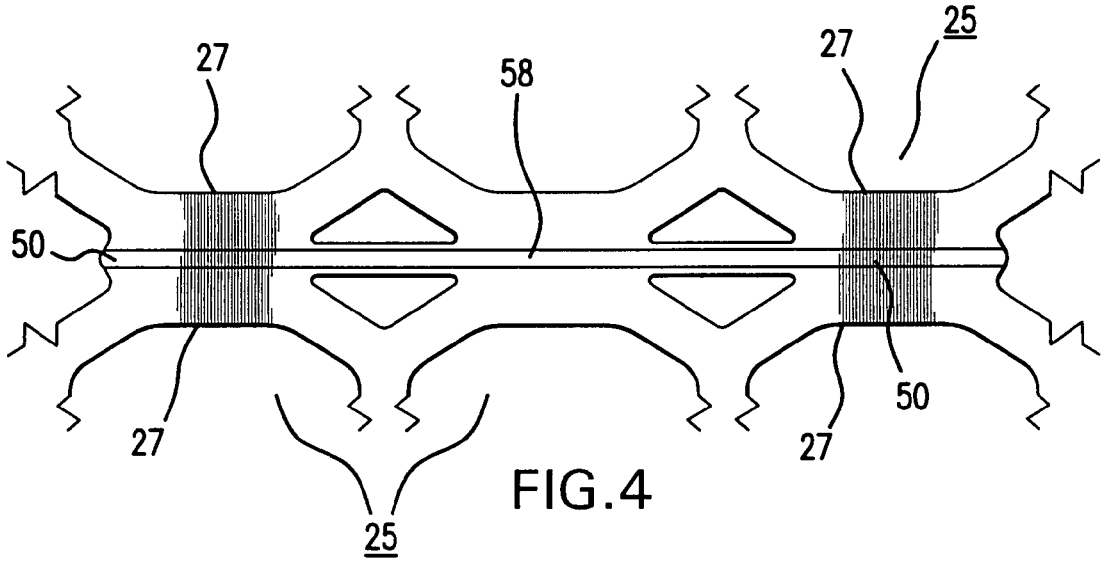
FIG. 4 is a top schematic view of a portion of a flexible carrier according to one preferred embodiment of this invention.

As best shown in FIGS. 1 and 4, according to one preferred embodiment of this invention, each container receiving aperture 25 includes tapered portion 27 that is tapered along an inner edge 33 toward a handle side of the row of flexible carrier 10, more specifically, each container receiving aperture 25 includes tapered portion 27 that is tapered toward weld 60. As used herein, "tapered" is defined as a container receiving aperture 25 becoming smaller toward one side, i.e., each container receiving aperture 25 is gradually diminished in width toward one side of the respective container receiving aperture 25.

Accordingly, each container receiving aperture 25 preferably comprises at least five generally straight segments that together form a generally polygonal shape that includes a tapered inner, or handle side, edge. As shown in FIG. 4, the tapered edge preferably comprises three generally straight segments that together form a plateau on the handle side of the flexible carrier 10. As shown in FIG. 1, an inner container receiving aperture 25 of the row includes six generally straight segments that together form a configuration having a taper or smaller side along the handle side of flexible carrier 10. Each outer container receiving aperture 25 of the row preferably includes five generally straight segments that together likewise form a configuration having a taper or smaller side along the handle side of flexible carrier 10. As defined herein, "straight segments" are respective segments of the perimeter of each container receiving aperture 25 each separated by a transition radius. Although such straight segments may include a slight radius, such transition radii each have a considerably smaller radius of curvature than the slight radii of such straight segments.

As a result of the described geometry, flexible carrier 10 may be applied to containers without interference from panel 40. Specifically, as a result of such geometry, the distance from outer edges 35 of each row of container receiving apertures 25 is substantial enough, and increased over the existing art, to permit engagement with machine jaws that apply flexible carrier 10 to containers 80.

In addition, problems of prior art carriers such as inversion of portions of the carrier relative to the containers are significantly reduced or eliminated by the geometry as described. As result of the configuration of the subject invention, flexible carrier 10 results in a tight and consistent package 100 without any movement of flexible carrier 10 relative to containers 80, particularly in areas surrounding container receiving apertures 25. As such, flexible carrier 10 will not move upward, downward or laterally relative to the unitized containers 80 and will thus maintain a solid package 100. In addition, the described geometry results in a vertically aligned panel 40 relative to package 100, as described in more detail below.

According to a preferred embodiment of this invention, a pitch of flexible carrier 10, i.e., a distance between center points of adjacent container receiving apertures 25 in each row, is constant across a longitudinal distance of flexible carrier 10. As such, a distance between a center of each outer container receiving aperture 25 to a center of the center container receiving aperture 25 is preferably identical.

As shown in FIG. 4, according to one preferred embodiment of this invention, handle 50 is formed along the centerline 58 between the two rows of container receiving apertures 25 and in a separate plane from the two rows of container receiving apertures 25. Specifically, as shown in FIG. 1, handle 50 is connected along a side of the row of container receiving apertures 25, and is preferably connected with respect to centerline 58, such as weld 60.

Handle 50 is preferably positioned along an outer periphery, or on an outboard side of flexible carrier 10. Handle 50 may additionally comprise one or more elongated apertures 55 positioned along the outer periphery of handle 50 or similar configuration that provides an ample area for a purchaser to grab by inserting his hand through and still maintain the purpose and integrity of package 100.

As best shown in FIG. 1, a plurality of struts 70 connect handle 50 with a side of the row of container receiving apertures 25, preferably between weld 60 and handle 50. As struts 70 are preferably formed in both layers of flexible sheet 20, one or more handle welds 75 may be positioned longitudinally across handle 50. The plurality of struts 70 may comprise inner struts 74 located across internal portions of container carrier 10 and outer struts 72 located across a periphery of container carrier 10.

Figure 5:
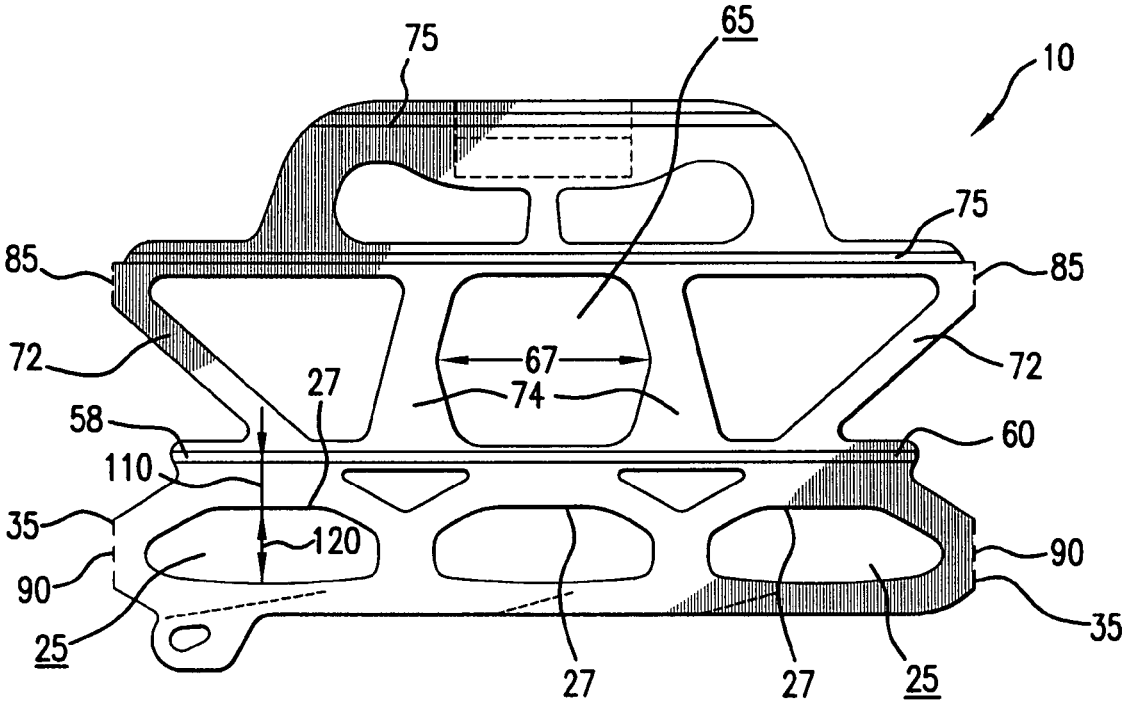
FIG. 5 is a side elevational view of a flexible carrier according to one preferred embodiment of this invention.

According to one preferred embodiment of this invention, each inner strut 74 preferably includes a non-uniform width as such inner strut 74 extends between the rows of container receiving openings 25 and handle 50. As shown in FIGS. 1 and 5 such inner struts 74 may be generally wider than outer struts 72.

According to one preferred embodiment of this invention, each outer strut 72 of the plurality of struts 70 extend longitudinally outward a distance approximately equal to each outer longitudinal edge 35 of the row of container receiving apertures 25. Flexible carriers 10, such as disclosed herein, are generally wound onto spools or reels or into boxes in a generally continuous end-to-end relationship. Without compensation, winding flexible carrier 10 having peripheral features such as handle 50 and panel 40 may result in tangling and knotting between and among adjacent flexible carriers 10 within the reel or box. As such, the present invention preferably includes at least two connection points between each adjacent flexible carrier 10 in the continuous string of flexible carriers 10. Such connection points maintain flexible carrier 10 in a flat, orderly position during the winding process.

As shown in FIG. 1, first connection point 85 is preferably located between outer struts 72 in adjacent flexible carriers 10. Second connection point 90 is preferably located between outer longitudinal edges 35 of the row of container receiving apertures 25 in adjacent flexible carriers 10. Because the row of container receiving apertures 25 may be formed in two contiguous layers of flexible sheet 20, second connection point 90 may actually comprise two overlapping connection points. By positioning outer struts 72 in a longitudinally outward manner, first and second connection points 85, 90 are generally aligned to permit smooth winding of generally continuous strings of flexible carriers 10.

According to one preferred embodiment of this invention as briefly described above, a generally continuous string of container carriers 10 may be placed into boxes for shipment and storage and subsequent application to groups of containers 80. A fan folding process may be employed wherein such strings of container carriers 10 are fan folded, like pin-feed computer paper, into a plurality of stacks of container carriers. Slaters, Jr., U.S. Pat. No, 6,068,125 issuing on 30 May 2000 and titled METHOD AND APPARATUS FOR STORING AND DISPENSING CONTAINER CARRIERS teaches one such method and is hereby incorporated by reference. Such fan folded stacks of container carriers may be placed onto dividers or rods so as to properly index the respective fan folded stacks.

According to one preferred embodiment of this invention, flexible carrier 10 may further include index aperture 65 located in an area between handle 50 and the rows of container receiving apertures 25. Index aperture 65 such as shown in FIGS. 1 and 5 may comprise a hexagon having a span 67 of at least approximately 1.5" and more preferably at least approximately 2.0". Such size of index aperture 65 permits fan folding of flexible carrier 10 in a manner consistent with the incorporated reference.

As best shown in FIGS. 1 and 3, panel 40 is preferably formed along a side of the row of container receiving apertures 25 opposite handle 50. Panel 40 preferably accommodates, on one or both sides, UPC and proof of purchase labels, graphics, and promotional and/or other information related to contents and/or ingredients of containers 80 and/or package 100.

Panel 40 may be separated from the row of container receiving apertures 25 with one or more panel slits 42. Panel slits 42 preferably follow the natural path of tear strip 45, discussed in more detail below, to assist in removal of containers 80 and/or panel 40 from flexible carrier 10.

According to one alternative embodiment of this invention, panel 40 may extend from each side of carrier 10 resulting in two panels 40, each extending from opposite sides of longitudinal row 25. FIG. 2 shows panels 40 positioned on each side of package 100. This configuration permits a panel 40 to face outward from a shelf regardless of how carrier 10 is placed on the shelf. In this arrangement of flexible carrier 10 wherein an additional panel 40 is formed along the side of the row of container receiving apertures 40, two contiguous panels 40 are formed in the two layers of flexible sheet 20.

Panel 40 may be generally continuous and unbroken, without cutouts or apertures, throughout its defined area, as shown in FIGS. 1 and 3. Alternatively, panel 40 may include one or more cutouts for weight reduction and material savings. An adhesive label may be applied to panel 40 to bring color, graphics and/or other information to panel 40.

As shown in FIGS. 1 and 3, panel 40 is preferably tapered along its transverse panel edges. Preferably, panel 40 extends in a transverse direction for a panel height at least as high as a width of container receiving aperture 25. More preferably, the panel height is at least as long as a distance from weld 60 to an outer edge 30 of the row of container receiving apertures 25. However, the panel height of panel 40 is preferably less than a height of container 80.

According to one preferred embodiment of this invention, tear strip 45 extends between panel 40 and the row of container receiving apertures 25. Accordingly, panel 40 and/or the container receiving apertures 25 are preferably separable along tear strip 45.

As shown in FIGS. 2 and 3, package 100 resulting from flexible carrier 10 includes a plurality of unitized containers 80. As a result of the described configuration, two layers of flexible sheet 20 joined with the longitudinally extending weld 60 include a row of container receiving apertures 25 formed in each layer of the two layers of flexible sheet 20. One row of container receiving apertures 25 is formed on each side of weld 60 resulting in flexible carrier 10 fanning out at weld 60 to permit a generally flat plane of engagement within which containers 80 are inserted. Each row of container receiving apertures 25 thereby engages a respective row of containers 80.

Handle 50 then extends upwardly from weld 60 and between each row of container receiving apertures 25. Struts 70 permit proper separation between weld 60 and handle 50 to permit a comfortable grasping area within package 100. As shown in FIG. 3, each outer strut 72 of the plurality of struts 70 extends longitudinally outward a distance beyond each outer longitudinal edge 35 of package 100.

One or more panels 40 accordingly extend downwardly from at least one row of container receiving apertures 25 so that each panel 40 extends generally flush with the respective row of containers 80.

While in the foregoing specification this invention has been described in relation to certain preferred embodiments thereof, and many details have been set forth for purpose of illustration, it will be apparent to those skilled in the art that flexible carrier 10 and the related method of manufacture are susceptible to additional embodiments and that certain of the details described herein can be varied considerably without departing from the basic principles of the invention.

The invention claimed is:

1. A flexible carrier for carrying a plurality of containers comprising:

two layers of flexible sheet;

a weld connecting the two layers of flexible sheet, the weld extending longitudinally along the layers;

a row of container receiving apertures formed in each layer of the two layers of flexible sheet;

a handle formed along one side of the row of container receiving apertures, wherein a container receiving aperture in the row of container receiving apertures includes five generally straight segments forming a taper toward the one side of the row of container receiving apertures; and a panel formed along a side opposite the one side of the row of container receiving apertures, wherein the panel comprises a panel height at least as long as a distance from the weld to an outer edge of the row of container receiving apertures.

2. The flexible cater of claim 1 further comprising:

an additional panel formed along the side of the row of container receiving apertures so that two contiguous panels are formed in the two layers of flexible sheet.

3. The flexible carrier of claim 1 further comprising:

a plurality of struts connecting the handle with the one side of the row of container receiving apertures.

4. The flexible carrier of claim 3 wherein each outer strut of the plurality of struts extend longitudinally outward a distance approximately equal to each outer longitudinal edge of the row of container receiving apertures.

5. The flexible carrier of claim 4 further comprising:

a first connection point with an adjacent flexible carrier formed between outer struts in adjacent flexible carriers; and a second connection point with the adjacent flexible carrier formed between outer longitudinal edges of the row of container receiving apertures in adjacent flexible carriers.

6. The flexible carrier of claim 3 further comprising:

an index aperture positioned between inner struts of the plurality of struts, the index aperture having a span of at least 1.5".

7. The flexible carrier of claim 6 wherein the index aperture is a hexagon having a span of at least 2.0".

8. The flexible carrier of claim 1 further comprising:

at least one handle weld extending between the two layers of flexible sheets forming the handle.

9. A package including a plurality of containers unitized within a flexible carrier, the package comprising:

a flexible sheet;

two rows of container receiving apertures formed in the flexible sheet, wherein a container receiving aperture in the row of container receiving apertures includes at least five generally straight segments forming a taper toward the one side of the row of container receiving apertures, each row of container receiving apertures engaging a respective row of containers;

a handle extending upwardly from between each row of container receiving apertures;

a panel extending downwardly from at least one row of container receiving apertures so that the panel extends generally flush with the respective row of containers; and a plurality of struts extending between the handle and the rows of container receiving apertures, wherein each outer strut of the plurality of struts extends longitudinally outward a distance beyond each outer longitudinal edge of the row of containers and wherein each inner strut of the plurality of struts includes a non-uniform width as each inner strut extends between the rows of container receiving openings and the handle.

10. The package of claim 9 further comprising:

two layers of flexible sheet joined with a longitudinally extending weld wherein a row of container receiving apertures is formed in each layer of the two layers of flexible sheet, one row on each side of the weld.

11. The package of Claim 9 wherein each container receiving aperture in the rows include a taper towards the handle.

12. The flexible carrier of claim 9 wherein the panel extends vertically against the plurality of containers and generally follows the contour of the plurality of containers.

13. A flexible carrier for carrying a plurality of containers comprising:

two layers of flexible sheet connected with a weld extending longitudinally between the two layers;

a row of container receiving apertures formed in each layer of the two layers of flexible sheet, each container receiving aperture having at least five generally straight segments that together form a tapered inner edge;

a handle integrated with the weld; and a panel integrated on an opposite side of the weld from the handles, wherein the panel comprises a panel height at least as long as a distance from the weld to an outer edge of the row of container receiving apertures.

14. The flexible carrier of claim 13 further comprising:

a plurality of struts connecting the handle with the handle side of the row of container receiving apertures.

15. The flexible carrier of claim 14 wherein each inner strut of the plurality of struts includes a non-uniform width as each inner strut extends between the rows of container receiving openings and the handle.

16. The flexible carrier of claim 13 further comprising:

a plurality of slits formed between the panel and the plurality of container receiving apertures.

17. The flexible carrier of claim 13 further comprising an additional panel formed along the flexible sheet wherein the additional panel comprises a different shape from the panel.

18. A flexible carrier for carrying a plurality of containers, said carrier comprising:

a handle suitable for manual grasping;

a flexible sheet having a plurality of container receiving apertures formed therein, each container receiving aperture having at least five generally straight segments that together form a tapered inner edge, the flexible sheet having a first edge connected to the handle;

a panel connected to the flexible sheet along a second edge of the flexible sheet generally opposite to the first edge;

a plurality of slits formed between the panel and the plurality of container receiving apertures;

an additional panel formed along the flexible sheet wherein the additional panel comprises a different shape from the panel; and wherein when the plurality of containers are disposed within the container receiving apertures and the handle is manually grasped in an anticipated orientation, the panel generally extends away from the flexible sheet in a direction remote from the handle more than toward the handle.

19. The flexible carrier of claim 18 comprising two layers of flexible sheet, each layer forming a row of container receiving apertures.

20. The flexible carrier of claim 19 further comprising a weld joining the two layers of flexible sheet between two rows of container receiving apertures.

21. The flexible carrier of claim 20 further comprising:

two panels, each panel of the two panels extending from adjacent a row of the two rows of container receiving apertures.

22. The flexible carrier of claim 18 wherein when the plurality of containers are disposed within the container receiving apertures and the handle is manually grasped in an anticipated orientation, the panel extends generally downward relative to the handle.

23. The flexible carrier of claim 22 wherein the panel extends vertically against the plurality of containers and generally follows the contour of the plurality of containers.

24. A flexible carrier for carrying a plurality of containers comprising:

a flexible sheet;

two rows of container receiving apertures funned in the flexible sheet, each row formed in a separate layer of flexible material, each container receiving aperture in each row having a length across a longitudinal distance of the flexible carrier 2 to 4 times greater than a corresponding width and each container receiving aperture having at least five generally straight segments that together form a tapered inner edge;

a centerline dividing the two rows of container receiving apertures wherein at least one container receiving aperture includes a taper extending toward the centerline;

a handle formed along one side of the row of container receiving apertures, wherein each container receiving aperture tapers toward the handle; and a panel formed along a side opposite the one side of the row of container receiving apertures, the panel extending in an opposite direction from the handle.

25. The flexible carrier of claim 24 comprising:

a weld connecting the two layers of flexible sheet, the weld extending longitudinally along the layers.

26. The flexible carrier of claim 24 wherein the length is 2.5 to 3.5 times greater than the corresponding width.

27. The flexible carrier of claim 24 wherein the centerline comprises a weld.

28. The flexible carrier of claim 24 wherein a centerline distance between the centerline and an inner, tapered edge of the container receiving aperture is approximately half of a width of the container receiving aperture.

29. The flexible carrier of claim 24 further comprising:

a plurality of struts extending between the handle and the row of container receiving apertures, wherein each inner strut of the plurality of struts includes a non-uniform width as each inner strut extends between the row of container receiving openings and the handle.

30. A flexible carrier for carrying a plurality of containers comprising:

a flexible sheet having a centerline;

two rows of container receiving apertures formed in the flexible sheet, one row positioned on each side of the centerline, wherein each container receiving aperture includes at least five generally straight segments that together form a taper toward the centerline;

a handle fanned along the centerline between the two rows of container receiving apertures and in a separate plane from the two rows of container receiving apertures; and a panel formed along a side opposite the one side of the row of container receiving apertures, wherein the panel comprises a panel height at least as long as a distance from the centerline to an outer edge of the row of container receiving apertures.

* * * * *